US007816012B2

(12) United States Patent
Gilberti et al.

(10) Patent No.: US 7,816,012 B2
(45) Date of Patent: Oct. 19, 2010

(54) SHEET PAPER MATERIAL WITH THE LOOK AND FEEL OF PLASTIC, AND RELATIVE PRODUCTION METHOD

(75) Inventors: Ferruccio Gilberti, Milan (IT); Mauro Mazzinghi, Milan (IT); Luca Monacelli, Pordenone (IT)

(73) Assignee: Gruppo Cordenons S.p.A., Milan (IT)

( * ) Notice: Subject to any disclaimer, the term of this patent is extended or adjusted under 35 U.S.C. 154(b) by 0 days.

(21) Appl. No.: 10/742,086

(22) Filed: Dec. 19, 2003

(65) Prior Publication Data

US 2004/0197573 A1 Oct. 7, 2004

(30) Foreign Application Priority Data

Dec. 20, 2002 (IT) ..... MI02A2737

(51) Int. Cl.
*B32B 27/20* (2006.01)
*B32B 27/40* (2006.01)
*B05D 1/00* (2006.01)

(52) U.S. Cl. ..... 428/425.1; 427/398.1; 427/274.4; 427/395

(58) Field of Classification Search ..... 428/425.1; 427/372.2, 374.1, 395, 398.1
See application file for complete search history.

(56) References Cited

U.S. PATENT DOCUMENTS 3,941,902 A * 3/1976 Wennerblom et al. ..... 427/172
4,125,411 A * 11/1978 Lyons ..... 106/416
4,619,966 A * 10/1986 Schafer et al. ..... 524/589
4,820,912 A * 4/1989 Samyn ..... 235/449
4,912,080 A * 3/1990 Weinstein ..... 503/200
5,177,128 A 1/1993 Lindemann et al.
5,660,919 A * 8/1997 Vallee et al. ..... 428/206
6,001,490 A * 12/1999 Rienacker et al. ..... 428/480

FOREIGN PATENT DOCUMENTS

| | | | |
|---|---|---|---|
| EP | 0 599 675 | A1 | 6/1994 |
| EP | 0 742 486 | A1 | 11/1996 |
| EP | 0 905 315 | A1 | 3/1999 |
| JP | 05 247889 | A | 9/1993 |
| JP | 06 072016 | A | 3/1994 |
| JP | 06-248598 | * | 9/1994 |
| JP | 06 248598 | A | 9/1994 |
| JP | 10060798 | A | 3/1998 |

OTHER PUBLICATIONS

European Search Report for EP 03 10 4866. Dated Mar. 24, 2004.

* cited by examiner

*Primary Examiner*—James Seidleck
*Assistant Examiner*—Saira Haider
(74) *Attorney, Agent, or Firm*—Patterson Thuente Christensen Pedersen P.A.

(57) ABSTRACT

There is provided a sheet paper material, at least one face of which is provided with a coating; the coating is a substantially even layer of a composition containing a mixture of polyurethane-base polymer material and kaolin; the coating has the look and feel of plastic, and permits high-quality printing; and the paper material is particularly suitable for packing prestige products.

29 Claims, No Drawings

SHEET PAPER MATERIAL WITH THE LOOK AND FEEL OF PLASTIC, AND RELATIVE PRODUCTION METHOD

The present invention relates to a sheet paper material and relative production method; the paper material being characterized by having the look and feel of plastic, and so being particularly suitable for packing prestige products.

BACKGROUND OF THE INVENTION

In the paper industry, new types of paper with a particular look and/or finish, especially for packing and packaging, illustration material, quality printing, etc., are continually being researched.

Frequently, however, the special effects achieved impair other characteristics of the paper, such as printability.

SUMMARY OF THE INVENTION

It is an object of the present invention to provide a paper material which differs in both look and feel from currently available paper materials, while at the same time being fully compatible with conventional printing techniques. More specifically, it is an object of the invention to provide a paper material with the look and feel of plastic, and which at the same time permits high-quality printing.

According to the present invention, there are provided a sheet paper material and relative production method.

Preferred embodiments of the paper material and relative production method are defined.

DETAILED DESCRIPTION OF THE INVENTION

More specifically, the paper material according to the invention comprises a substantially known paper support, e.g. a cellulose-base paper of conventional composition and, preferably, approximately 90 to 350 g/m$^2$ substance.

At least one face of the paper support has an outer coating which, in use, constitutes the outermost, i.e. outer-surface, layer of the paper material. In accordance with the invention, the coating is spread on using an air-blade or sliding-blade coating machine, and has the look and feel of plastic, while at the same time permitting high-quality printing.

The paper support has an extremely smooth, homogeneous surface. More specifically, the face of the paper support to which the coating is eventually applied has a substantially smooth, homogeneous surface, with a finish, measured using a Bendtsen apparatus, ranging between approximately 30 and 70 ml/min, and a Cobb water absorption index of approximately 18 g/m$^2$ or less.

The coating is defined by a substantially even, homogeneous layer of a composition comprising polyurethane-base polymer material, mineral pigment, preferably silica and/or one or more silicone products, and optional water retainers.

The term "polyurethane-base polymer material" indicates a polymer or mixture of polymers in which the main or predominant component is a polyurethane, i.e. a polyurethane-structured polymer. In accordance with the invention, the polyurethane is an elastomeric polyurethane.

The mineral pigment is a kaolin (aluminium hydrosilicate) or mixture of kaolins; in accordance with the invention, lamellar-structured kaolins are preferably used; and calcined or natural (non-calcined) kaolins may be used.

The silica is preferably colloidal silica; and the term "silicone products" indicates a silicone or mixture of silicones.

The water retainers are known types, e.g. carboxymethyl cellulose, polyvinyl alcohol or PVA, casein, or similar, and may be used either singly or mixed together.

In a preferred embodiment of the invention, the coating composition comprises, dry:

- approximately 5 to 100 parts by weight of polymer material per 100 parts by weight of kaolin (i.e. approximately 5 to 100% by weight, dry, of polymer material with respect to the kaolin quantity);
- approximately 1 to 10 parts by weight of silica and/or silicone products per 100 parts by weight of kaolin (i.e. approximately 1 to 10% by weight, dry, of silica and/or silicone products with respect to the kaolin quantity);
- approximately 0.5 to 2 parts by weight of water retainers per 100 parts of kaolin (i.e. approximately 0.5 to 2% by weight, dry, with respect to the kaolin quantity).

The composition is applied to the face of the paper support in a quantity ranging between approximately 5 and 20 g/m$^2$.

In a preferred embodiment of the invention, the composition substantially comprises a mixture of polyurethane-base polymer material, kaolin, and optional water retainers; in a further preferred embodiment, the composition substantially comprises a mixture of polyurethane-base polymer material, kaolin, silica and/or silicone products, and optional water retainers; the silica and/or silicone products greatly enhance the desired plastic feel.

The composition may optionally comprise other known components and additives for specific functions.

The outer surface of the coating formed on the paper support has a finish, measured using a Bendtsen apparatus, of approximately 70 to 250 ml/min, and a Cobb water absorption index of approximately 18 to 30 g/m$^2$.

Both faces of the paper support may obviously be coated with respective coatings defined by respective substantially even layers of the composition described above.

In accordance with a further aspect of the present invention, the paper material described above is produced using the following method.

The paper support is produced in known manner, e.g. in the form of a web on a continuous paper-making machine, of conventional composition and approximately 90 to 350 g/m$^2$ substance. The paper support is produced and possibly processed (in known manner)—in particular, finished—to achieve an extremely smooth, homogeneous surface, and, more specifically, so that the face to which the coating is eventually applied has a finish, measured using a Bendtsen apparatus, of approximately 30 to 70 ml/min, and a Cobb water absorption index of approximately 18 g/m$^2$ or less.

A substantially homogeneous composition of the above quantities of polyurethane-base polymer material, kaolin, and optional silica and/or silicone products and water retainers is prepared in known manner. The polymer material is used, for example, in the form of a polymerizable aqueous dispersion.

A substantially even layer of the composition is then applied to one or both faces of the paper support web.

The way in which the composition is applied to form the coating is extremely important to achieve the desired plastic feel. In particular, the composition is spread on using an air-blade or sliding-blade coating machine. Impregnation does not appear to give the same results. Polymerization of the polymer material takes place (or at least is completed) after the composition is applied to the paper support.

The composition is applied so as to leave approximately 5 to 20 g/m$^2$ (dry quantity) of composition on each face of the paper support to be coated.

This is followed by heating, to dry the coating and induce polymerization of the polymer material, in a known (e.g.

infrared and/or hot-air) oven at a temperature of about 100 to 180° C. for approximately 30 seconds to 4 minutes.

The paper material, still in web form, is then cooled, e.g. in a cold-air chamber, at a temperature of preferably below 10° C.; and is then aerated by blowing air at ambient temperature over one or both faces of the web of paper material.

The paper material is then ready for storage and/or use, in particular for packing prestige products.

If both faces of the paper support are provided with respective coatings, respective substantially even layers of the composition may be applied to the two faces of the paper support web either simultaneously or in separate successive steps.

The advantages of the present invention will be clear from the foregoing description: in particular, it provides a paper material which looks and feels like plastic and so produces a "surprising" sensation when handled.

Unlike conventional coated paper, for example, the paper material according to the invention is also perfectly printable to a high quality standard using conventional, in particular, ink, printing techniques, and can safely be subjected to practically any other conventional process (folding, gumming, etc.).

The invention is further described by way of example in the following non-limiting embodiments.

Example 1

Various numbers of paper supports of 90, 100, 150, 200, 250, 300 and 350 g/m$^2$ substance were prepared as described above; and, for each substance, samples were obtained with a 30, 40, 50, 60 and 70 ml/min finish (measured using a Bendtsen apparatus) and 5, 10, 12, 15, 17 and 18 g/m$^2$ Cobb index.

Mixtures were prepared of polyurethane-base polymer materials and kaolins in the proportions shown in Table 1.

TABLE 1

| mixtures of polyurethane-base polymer material (PU) and kaolin [parts by weight] | | | | | | |
|---|---|---|---|---|---|---|
| KAOLIN | 1 | 1 | 1 | 1 | 1 | 1 |
| PU | 0.05 | 0.1 | 0.5 | 0.7 | 0.8 | 1 |

Water retainers (carboxymethyl cellulose, polyvinyl alcohol or PVA, casein, or similar, used singly or mixed together) were added to the above mixtures in quantities ranging from 0.5 to 2% by weight with respect to the kaolin quantity.

The resulting compositions were then applied to one or both faces of the paper supports in varying quantities, in particular 5, 7, 10, 12, 15, 18, 20 g/m$^2$, using the method described previously.

Coatings with the look and feel of plastic and permitting high-quality printing were obtained.

Example 2

Paper supports similar to those in Example 1 were used; and, to compositions prepared as in Example 1, silica, silicone products or mixtures of silica and silicone products were added in quantities ranging from 1 to 10% by weight with respect to the kaolin quantity, and in particular 1, 2, 3, 4, 5, 6, 7, 8, 9 and 10%.

The resulting compositions were then applied to one or both faces of the paper supports in varying quantities, in particular 5, 7, 10, 12, 15, 18, 20 g/m$^2$, using the method described previously.

Coatings with the look and feel of plastic and permitting high-quality printing were again obtained. The plastic feel was more marked than in identical paper materials with no silica and/or silicone products.

The invention claimed is:

1. A high-quality-printable sheet paper material, particularly for packing prestige products, comprising a paper support characterized in that said paper support is a cellulose-base paper having at least one face to which a coating is applied, and characterized in that said coating is a substantially even layer of a composition comprising a polyurethane-base polymer material and approximately 1 to 10 parts by weight of silica and/or one or more silicone products per 100 parts by weight of kaolin; which coating is spread onto said face, and has the look and feel of plastic, characterized in that without the coating said face of the paper support has a substantially smooth, homogeneous surface having a finish, measured using a Bendtsen apparatus, of approximately 30 to 70 ml/min, and further characterized in that the coating has an outer surface having a finish, measured using a Bendtsen apparatus, of approximately 70 to 250 ml/min.

2. A paper material as claimed in claim 1, characterized in that said polyurethane-base polymer material is an elastomeric polyurethane.

3. A paper material as claimed in claim 1, characterized in that the kaolin is a lamellar-structured kaolin.

4. A paper material as claimed in claim 1, characterized in that said composition comprises approximately 5 to 100 parts by weight of polymer material per 100 parts by weight of kaolin.

5. A paper material as claimed in claim 1, characterized in that said composition comprises approximately 0.5 to 2 parts by weight of water retainers per 100 parts by weight of kaolin.

6. A paper material as claimed in claim 1, characterized in that said composition is applied to said face in a quantity ranging approximately from 5 to 20 g/m2.

7. A paper material as claimed in claim 1, characterized in that said paper support is of approximately 90 to 350 g/m$^2$ substance.

8. A paper material as claimed in claim 1, characterized in that, without the coating, said paper support has a Cobb water absorption index of less than approximately 18 g/m$^2$.

9. A paper material as claimed in claim 1, characterized in that, with the coating, the paper support has a Cobb water absorption index of approximately 18 to 30 g/m$^2$.

10. A method of producing a high-quality-printable sheet paper material, characterized by comprising a step of producing a paper support in the form of a web; a step of preparing a substantially homogeneous composition comprising a polyurethane-base polymer material and kaolin; and a step of spreading a substantially even layer of said composition onto at least one face of the web to form a coating having the look and feel of plastic, the method characterized by comprising a step of cooling the paper material with the coating, and in which the coating is cooled at a temperature of approximately 10° C. or less.

11. A method as claimed in claim 10, characterized in that said polymer material is an elastomeric polyurethane.

12. A method as claimed in claim 10, characterized in that the kaolin is a lamellar-structured kaolin.

13. A method as claimed in claim 10, characterized in that said composition comprises approximately 5 to 100 parts by weight of polymer material per 100 parts by weight of kaolin.

14. A method as claimed in claim 10, characterized in that said composition comprises approximately 1 to 10 parts by weight of silica and/or one or more silicone products per 100 parts by weight of kaolin.

15. A method as claimed in claim 10, characterized in that said composition comprises approximately 0.5 to 2 parts by weight of water retainers per 100 parts by weight of kaolin.

16. A method as claimed in claim 10, characterized in that said composition is applied to said face in a quantity ranging approximately from 5 to 20 g/m$^2$.

17. A method as claimed in claim 10, characterized in that said paper support is of approximately 90 to 350 g/m$^2$ substance.

18. A method as claimed in claim 10, characterized in that said paper support, without the coating, is produced with a Cobb water absorption index of less than approximately 18 g/m$^2$.

19. A method as claimed in claim 10, characterized in that, with the coating, the paper support has a Cobb water absorption index of approximately 18 to 30 g/m$^2$.

20. A method as claimed in claim 10, characterized in that, in said step of spreading on said layer, the composition is spread onto said face using an air-blade or smoothing-blade coating machine.

21. A method as claimed in claim 10, characterized in that the polymer material is used in the form of a polymerizable aqueous dispersion.

22. A method as claimed in claim 10, characterized by comprising a step of heating said coating in an oven at a temperature of approximately 100 to 180° C. to induce polymerization of said polymer material.

23. A method as claimed in claim 22, characterized in that said heating step is performed with an oven time of approximately 30 seconds to 4 minutes.

24. A method as claimed in claim 10, characterized by comprising an aerating step following the cooling step.

25. A method of producing a high-quality-printable sheet paper material, characterized by comprising a step of producing a paper support in the form of a web characterized in that said paper support is a cellulose-base paper; a step of preparing a substantially homogeneous composition comprising a polyurethane-base polymer material and approximately 1 to 10 parts by weight of silica and/or one or more silicone products per 100 parts by weight of kaolin; and a step of spreading a substantially even layer of said composition onto at least one face of the web to form a coating having the look and feel of plastic, characterized by comprising a step of finishing said face of the paper support to provide said face, prior to application of the coating with a substantially smooth, homogeneous surface having a finish, measured using a Bendtsen apparatus, of approximately 30 to 70 ml/min, and further characterized that the coating is formed with an outer surface having a finish, measured using a Bendtsen apparatus, of approximately 70 to 250 ml/min.

26. A sheet paper material comprising:

a cellulose-based paper support of a substance between about 90 g/m$^2$ to about 350 g/m$^2$, the paper support presenting a face;

a substantially even coating on the face of the paper support, the coating applied in a quantity between about 5 g/m$^2$ to about 20 g/m$^2$, the coating comprising:

5 to 100 parts by weight of polyurethane-base polymer material per 100 parts by weight of kaolin; and 1 to 10 parts by weight of silicone-base material per 100 parts by weight of kaolin;

wherein the coating is applied with an air blade coating machine or a sliding blade coating machine and cooled at a temperature of approximately 10° C. or less after application such that an outer surface of the coating presents a finish, measured using a Bendtsen apparatus, of approximately 70 to 250 ml/min, and the sheet paper material has the look and feel of plastic.

27. The sheet paper material of claim 26, wherein the polyurethane-base polymer material is an elastomeric polyurethane.

28. The sheet paper material of claim 26, wherein the kaolin is a lamellar-structured kaolin.

29. A paper material comprising:

a cellulose-based paper support of a substance between about 90 g/m$^2$ to about 350 g/m$^2$, the paper support presenting a face;

a substantially even coating on the face of the paper support, the coating applied in a quantity between about 5 g/m$^2$ to about 20 g/m$^2$, the coating comprising:

5 to 100 parts by weight of polyurethane-base polymer material per 100 parts by weight of kaolin; and 1 to 10 parts by weight of silicone-base material per 100 parts by weight of kaolin;

an outer surface of the coating presenting a finish, measured using a Bendtsen apparatus, of approximately 70 to 250 ml/min, the paper material having the look and feel of plastic.

* * * * *